US005283589A

United States Patent [19]

Blevins

[11] Patent Number: 5,283,589

[45] Date of Patent: Feb. 1, 1994

[54] WINDOW MOUNTABLE UHF MOBILE ANTENNA SYSTEM

[75] Inventor: Peter D. Blevins, Freehold, N.J.

[73] Assignee: Richard Hirschmann of America, Inc., Riverdale, N.J.

[21] Appl. No.: 831,577

[22] Filed: Feb. 5, 1992

[51] Int. Cl.[5] ..... H01Q 1/32

[52] U.S. Cl. ..... 343/715; 343/713

[58] Field of Search ..... 343/713, 715, 749, 745-748, 343/846, 860; 333/24 C, 32

[56] References Cited

U.S. PATENT DOCUMENTS

| | | | |
|---|---|---|---|
| 4,565,745 | 1/1986 | Kaminskas | 343/912 |
| 4,785,305 | 11/1988 | Shyu | 343/713 |
| 4,794,319 | 12/1988 | Shimazaki | 343/715 |
| 4,825,217 | 4/1989 | Choi | 343/715 |
| 4,839,660 | 6/1989 | Hadzoglou | 343/715 |
| 4,857,939 | 8/1989 | Shimazaki | 343/715 |
| 4,862,183 | 8/1989 | Blaese | 343/715 |
| 4,916,456 | 4/1990 | Shyu | 343/713 |
| 4,931,806 | 6/1990 | Wunderlich | 343/715 |
| 4,992,800 | 2/1991 | Parfitt | 343/713 |
| 5,105,201 | 4/1992 | Nakase et al. | 343/713 |

*Primary Examiner*—William Mintel

*Assistant Examiner*—Peter Toby Brown

*Attorney, Agent, or Firm*—Robert J. Koch; Mark Ungerman

[57] ABSTRACT

A UHF mobile radio communications antenna that may be mounted on a vehicle window without drilling into or damaging the surface of the vehicle. An exterior part includes an antenna element and a resonant coupling circuit, and may be removably mounted to the exterior of the vehicle window. An interior part includes a resonant coupling circuit and a ground counterpoise, and may be removably mounted to the interior of the same window and positioned in alignment with the exterior part. The exterior and interior parts are in radio frequency communication by electromagnetic coupling therebetween. The interior part functions additionally as a radio frequency ground counterpoise independent of any vehicle metal. The interior part is adapted for connection to a mobile radio transceiver by coaxial cable. No post installation tuning of the invention is required and, thus, the invention may be easily installed without special skills. Use of adhesive pads for attachment of the interior and exterior parts to the vehicle window allows easy removal therefrom and without damage thereto.

17 Claims, 3 Drawing Sheets

FIG.3
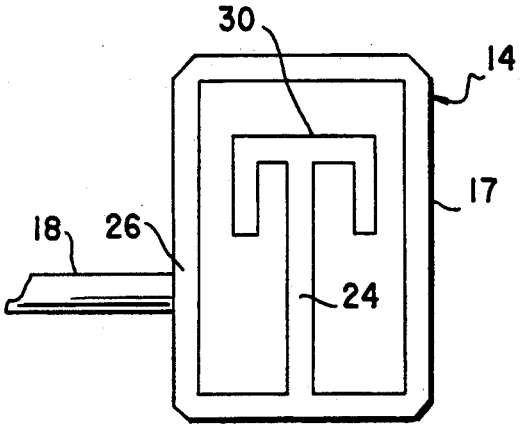
FIG.4
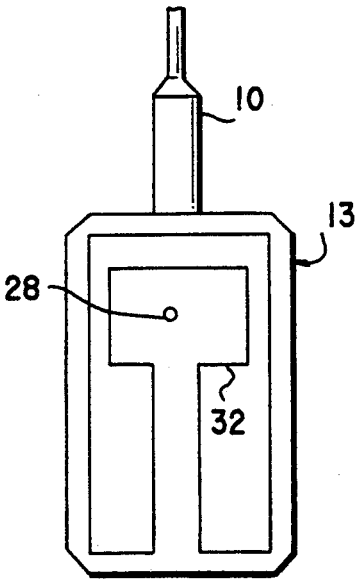
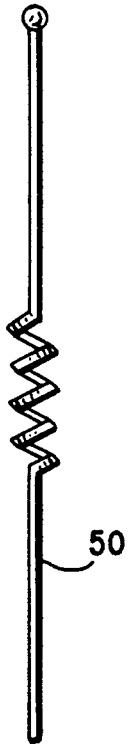
FIG.5

WINDOW MOUNTABLE UHF MOBILE ANTENNA SYSTEM

BACKGROUND OF THE INVENTION

1. Field of Invention

The present invention relates generally to communications antennas and in particular to a UHF mobile communications antenna that may be attached to a vehicle window without drilling into or damaging the surface of the vehicle or window.

2. Description of the Related Technology

Mobile two-way communications for police, fire, taxicab and business use have generally been in the radio frequency bands of 32–40 MHz, 150–174 MHz, 420–270 MHz and 800–900 MHz. Cellular telephones using the 800 MHz band have become extremely popular for both business and personal use in recent years. As the radio bands used increase in frequency, higher gain and more efficient antennas are desirable. In addition to high efficiency and high gain, a broad bandwidth is also necessary for mobile telephone applications such as, for example, the new cellular mobile systems. Desirable features in any antenna system are broad bandwidth, gain, good efficiency, and low voltage standing wave ratio ("VSWR"). These requirements are necessary for proper operation with modern day mobile radio transceivers.

At VHF and UHF radio frequencies the distance that one may communicate is normally limited to line of sight. Therefore, the higher the mobile antenna is located on the vehicle, the better the useful communications range. A desirable antenna radiation pattern will produce the most efficient operation of the antenna and result in maximum clear signal range. The radiation pattern of an antenna is affected by the antenna's proximity to metal objects on or of the vehicle. Therefore, the most desirable location for an antenna on a vehicle would be the rooftop or mounting as close to the roof line of an automobile as possible.

To permanently mount a mobile antenna on a vehicle required drilling or cutting a hole into the vehicle body and then inserting the antenna in the hole. The metal surface of the vehicle acted as a ground plane for the mounted vertical antenna radiating element. Use of the vehicle body as a ground plane was mandatory for maximum efficiency in antenna operation. With alternate locations on a car such as the fender or trunk lid or bumper, the ground plane was not optimal and the antenna efficiency and radiation pattern suffered.

The hole cut in the vehicle body for installation of the mobile antenna resulted in damage that was expensive to repair when the antenna had to be removed. As automobiles increased in price and the cost of subsequent body repair work increased, a more satisfactory arrangement for permanently mounting mobile radio antennas to expensive vehicles without damage was desired without sacrificing communications performance.

Antenna systems, called "on-the-glass antennas," were devised that were removably mountable on a window of a vehicle without damage thereto. An antenna part was attached to the exterior surface of the window by means of glue, such as epoxy, or adhesive tape pads. An interior part was attached to the interior surface of the same window by similar means and in alignment with the antenna part. Radio frequency energy was transferred between the interior part and exterior antenna part by capacitive coupling.

A coupling capacitor was created when a conductive base plate, connected to the antenna element, was mounted to the exterior surface of a window forming one side of the capacitor, and an interior plate was mounted to the interior of the window opposite the exterior plate forming the other plate of the capacitor. The window glass was the dielectric insulator between the exterior and interior plates. Thus, radio frequency signals could pass between the exterior and interior parts of the antenna system without the necessity for any actual physical connection requiring a hole in the vehicle.

Early on-the-glass antennas, however, suffered from ineffective and inefficient ground planes or ground counterpoises. These antennas used either the interior metal parts of the vehicle or the coaxial cable outer shield conductor as a ground counterpoise. Using either resulted in radiation of radio frequency energy inside of the passenger compartment. This undesirable radiation was emitted from the outer shield of the coaxial cable that connected the antenna system to a mobile radio transceiver. Studies have revealed that radiation of radio frequency energy from a mobile radio transceiver may cause harmful effects to occupants within a vehicle. Therefore, reduction of radio frequency radiation within the vehicle was very important.

Further work was needed to reduce this radio frequency radiation problem. An early attempt to solve the radiation problem was to utilize a coupling device attached to the inside window that would function as a ground counterpoise and effectively decouple stray radio frequency energy from the outer coaxial cable shield. In addition, matching networks of various types were employed to reduce the VSWR of these antenna systems. A device of this type is shown in U.S. Pat. No. 4,839,660, the disclosure of which is incorporated by reference herein. However, all of the aforementioned on-the-glass antenna systems used capacitive (electrostatic coupling) to couple the radio frequency energy between the interior part and the exterior antenna part.

Capacitive coupling was detrimentally affected by stray capacitive coupling from adjacent conductive metal parts of the vehicle such as the window trim ring or embedded de-icing strips in a rear window. Normally, because of the vagaries of mounting locations for on-the-glass mobile antennas, the capacitive coupling effects of each installation cannot be determined beforehand with any certainty. Adjustable matching networks have been incorporated into antenna systems to tune for optimal performance after installation. Thus, each type of vehicle and different location thereon required post installation tuning adjustment for proper operation. Tuning of the antenna matching system required special test equipment and special knowledge of the radio technician to effectively adjust the antenna system for maximum radiation and minimum VSWR.

SUMMARY OF THE INVENTION

In contrast to prior on-the-glass mounted antennas, the system of the present invention is designed utilizing a coupling technique that is minimally affected by stray capacitance of the vehicle metal body parts and requires no post-installation tuning for optimal efficiency and minimum VSWR. The present invention is a communications antenna system that may be adapted to operate in or near the 400 to 500 MHz or 800 to 1000 MHz frequency bands and is designed for mounting on a radio frequency transparent surface such as a window of an automobile or truck. Particularly the antenna according to the invention may be adapted to operate at 406–512 MHz, 806–960 MHz for operation in the U.S., and at other operating ranges as appropriate in Europe or other countries and for cellular, trunking or other applications. The antenna system of the present invention provides excellent efficiency and gain with sufficient bandwidth, and low VSWR for optimal use with modern day solid state mobile radio frequency transceivers.

In accordance with the present invention, an exterior antenna is fixedly mounted to the exterior surface of a vehicle window such as the back window of a car. This exterior antenna may be approximately a one half wave vertical radiating element or a multiple wave length collinearly-phased vertical antenna. Depending on the frequencies of use and the required gain characteristics of the antenna radiating element, a variety of different types of antennas may be utilized. These antenna types may be approximately one half wave length, collinear-phased, or any other appropriate type of antennas operable at or near the 400–500 MHz or 800–1000 MHz frequency bands. At the higher frequency bands multiple wave length antennas collinearly-phased for better gain and more optimal low angle radiation patterns may also be utilized. Alternate antennas may be utilized with the present invention for police undercover work or other applications where it is desirable to disguise the type of service of the antenna.

The external antenna radiating element of the present invention is connected to a resonant coupling circuit. This resonant coupling circuit is part of and resonates with the antenna radiating element. Thus, the exterior antenna part has a coupling circuit that is resonant in the frequency band of interest. The present invention uses an interior counterpoise part also having a resonant coupling circuit connected in cooperation with a ground counterpoise system that eliminates the need for connection to any metal parts of the vehicle for proper antenna performance. In addition, this ground counterpoise of the interior part of the present invention effectively decouples the coaxial cable and minimizes any radio frequency energy from appearing on the coaxial cable outer conductor shield.

The exterior antenna part of the present invention advantageously is mounted on the exterior surface of a vehicle window directly opposite and in alignment with the interior counterpoise part mounted on the interior of the vehicle window. When positioned as described above, radio frequency energy communicates between the interior and exterior parts of the present invention by electromagnetic coupling of the respective interior and exterior resonant coupling circuits.

Use of electromagnetic coupling in the present invention has the following advantages: Stray capacitive coupling does not affect the tuning or operational characteristics of the electromagnetically coupled circuits nearly as much as stray capacitance would affect capacitive coupling. No post-installation tuning is required of the present invention. System frequency bandwidth is greater than in capacitively coupled antenna systems.

The interior unit of the present invention exhibits a resonant cavity that is adjacent to an electrically small drooping monopole antenna that together with said cavity is resonant in the desired operating frequency band. The exterior part of the present invention may be a top loaded monopole antenna which, when co-joined with the resonant coupling element, provides for efficient radio frequency energy transfer.

The exterior and interior parts of the present invention may be mounted to the vehicle window by an adhesive attachment, such as epoxy glue or adhesive pads. The window is transparent to the radio frequency energy and causes minimal loss of radio frequency energy between the tuned coupling circuits contained within the exterior and interior parts of the present invention.

Immediately after installation, the present invention is ready for operation with wide frequency bandwidth and low VSWR. The system of the present invention is extremely broad band and has, for example, greater than 100 MHz bandwidth at 850 MHz with VSWR of less than 1.5:1, and greater than 60 MHz bandwidth at 450 MHz with VSWR of less than 1.8:1. The system of the present invention eliminates the need for tunable components and the post-installation radio technician alignment requiring special test equipment and technician skills.

The present invention utilizes a resonant coupling circuit within the interior part of the invention. This coupling circuit is DC grounded to minimize noise susceptibility from static electric charges and other RF energy sources. A coaxial cable is attached to the coupling circuit and connects to the radio transceiver. The interior coupling circuit is designed to present the correct load impedance to the transceiver and to efficiently communicate the radio frequency signals to the exterior coupling circuit.

Radiation from the coaxial cable conductive shield is reduced or eliminated by a resonant cavity formed from a conductive surface of the interior part of the present antenna system. The conductive surface of the resonant cavity acts as a shield between the vehicular interior and radio frequency energy in the coupling network. This provides the additional benefit of greatly reducing the potential for energy being directly radiated toward the vehicle interior, thus, reducing the amount of radiation emitted to the passengers and driver of the vehicle.

The antenna system of the present invention may have an exterior part which includes a radiating antenna element, an angle adjustment mechanism and resonant coupling circuit. The exterior coupling circuit is electrically connected to the antenna element, forming a resonant circuit at the frequencies of use. The coupling circuit may be implemented by a printed circuit board mounted within a dielectric enclosure and forming a face thereto. The face of the dielectric enclosure is fixedly attached to the exterior surface of the vehicle window.

The interior unit may include a resonant cavity enclosure, a printed circuit board having a resonant coupling circuit connected to a coaxial cable. The outer shield conductor of the coaxial cable may be electrically connected to the conductive cavity shield. The inner conductor is advantageously electrically connected to the coupling circuit on an internal printed circuit board at a point that matches the coaxial cable characteristics impedance. Attachment means, such as double sided adhesive pads, secure the interior and exterior units to the vehicle window. Radio frequency energy is coupled from the center conductor of the coaxial cable to the resonant coupling circuit, and then couples electromagnetically through the adhesive pads and window of the vehicle to the external coupling circuit which transfers the radio frequency energy to the radiating antenna element attached to the angle adjusting mechanism.

The resonant frequencies of both coupling circuits may be changed by alteration of the printed circuit board dimensions and antenna radiating element length. In addition, different dielectric material may be used in the printed circuit board and/or the adhesive attachment means to vary the resonant frequencies of these two coupling circuits. The cavity may be formed by PCB and the resonant cavity enclosure may be filled with dielectric material to change the frequency.

An object of the present invention is to efficiently communicate radio frequency energy through a dielectric medium such as a glass window of a vehicle.

Another object of the present invention is to electromagnetically couple radio frequency energy by a tuned resonant coupling circuit.

Another object of the present invention is to fixedly mount a UHF antenna system for mobile vehicular communications without damaging the surface of an automobile.

Another object of the present invention is an antenna system that may be easily mounted on a window of a vehicle by unskilled technicians so that no special test equipment or tuning procedures are needed for efficient and optimal operation of the antenna system.

Another object of the present invention is to obtain wide bandwidth over the desired operating frequencies of interest with consistently low VSWR for proper transfer of radio frequency power from modern solid state radio frequency mobile transceivers.

Another object of the present invention is an antenna system that operates in or near the 400–500 MHz UHF frequency band.

Another object of the present invention is an efficient high gain mobile communications antenna system that operates in the cellular and other mobile telephone frequency bands between 800–1000 MHz.

Another object of the present invention is a low cost mobile communications antenna system that may be easily installed by untrained personnel and resulting in optimal system operation without having to make any tuning adjustments by expert technicians using expensive test equipment.

Another object of the present invention is to properly match the 50 ohm impedance of the coaxial cable.

Further objects, features and advantages will be readily apparent from the following detailed description of the presently preferred embodiment of the invention, given for the purpose of disclosure and taken in conjunction with the accompanying drawings.

BRIEF DESCRIPTION OF THE DRAWINGS

FIG. 3 is an elevational view of the interior part printed circuit board assembly;

FIG. 4 is an elevational view of the exterior part printed circuit board assembly; and FIG. 5 shows a radiating element.

DETAILED DESCRIPTION OF THE PREFERRED EMBODIMENT

Figure 1:
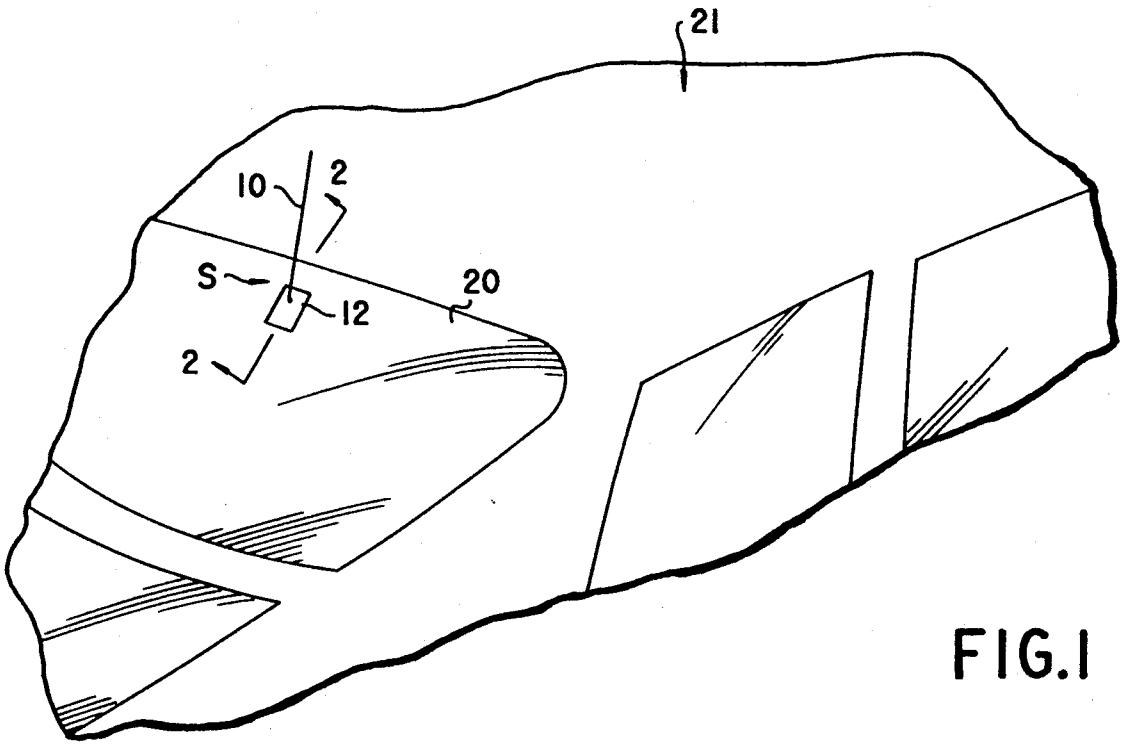
FIG. 1 is a perspective view illustrating an antenna mounted on a vehicle window.

Referring now to the drawings, and particularly to FIG. 1, the reference S generally indicates an antenna system. The antenna system of the present invention is mounted on a rear window 20 of vehicle 21. The antenna may be mounted on any dielectric surface of a car, other vehicle or other structure. The antenna should not restrict mechanical motion of the mounting surface. An antenna radiating element 10 is pivotally attached to an exterior dielectric enclosure 12 that is fixedly attached to the window 20. A cross-sectional view 2—2 of the system of the present invention is illustrated in FIG. 2.

Figure 2:
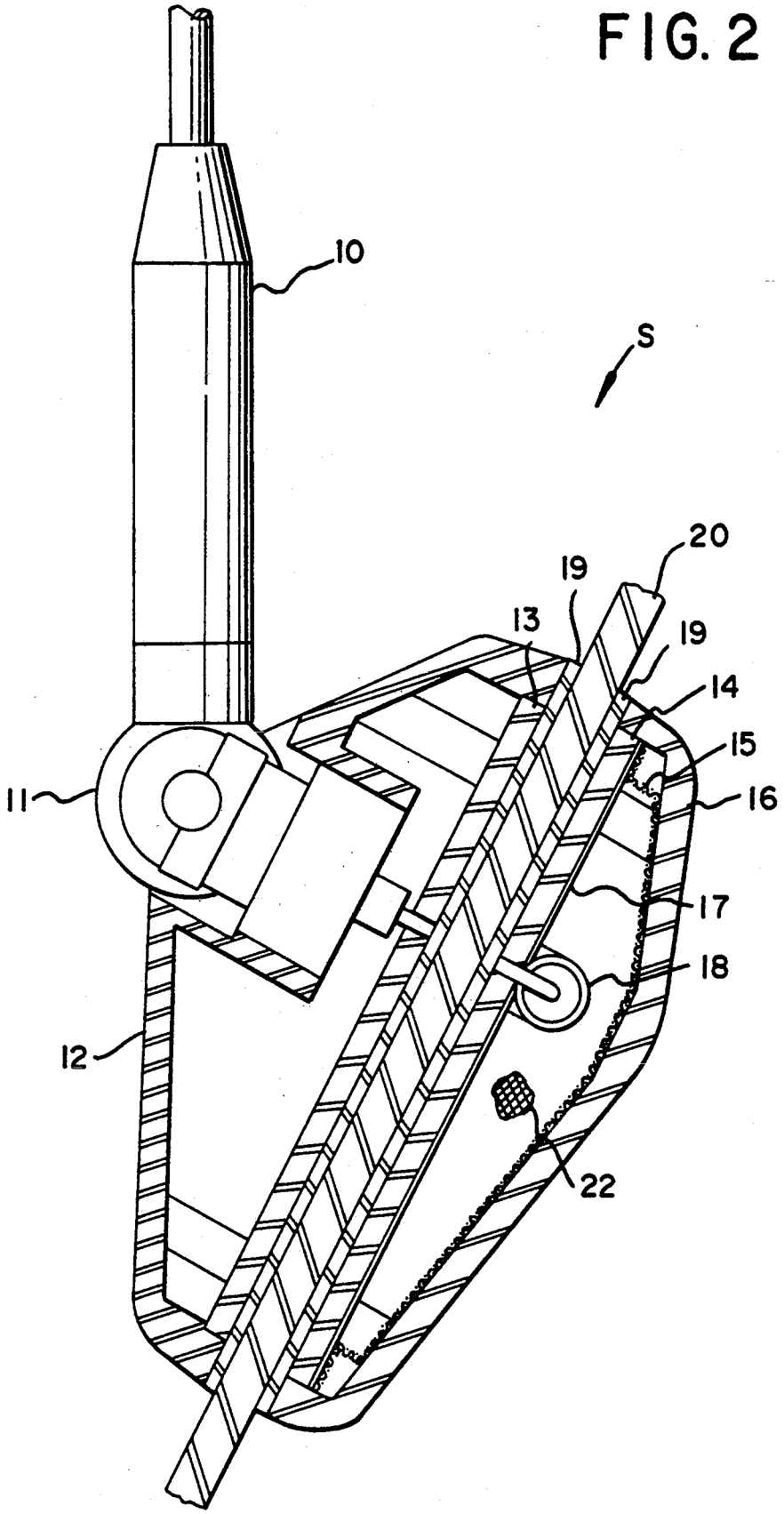
FIG. 2 is a cross-sectional view of the antenna illustrated in FIG. 1 in which the cross-section is taken along lines 2—2.

Referring now to FIG. 2, the antenna radiator element 10 may be screwably attached to angle adjusting mechanism 11 which is fixedly attached to exterior dielectric enclosure 12. Exterior antenna printed circuit board 13 is enclosed within the dielectric enclosure 12 and forms a face therewith. Printed circuit board 13 contains a resonant coupling circuit, more fully described below, connected to antenna element 10. The resonant coupling circuit may be connected to an approximately one half wave length element 10 or a collinear-phase element 50 (FIG. 5). An adhesive dielectric pad 19 is disposed against and adheres to a face defined by the assembly of dielectric enclosure 12 and the antenna printed circuit board 13. The adhesive dielectric pad 19 has adhesive on both of its faces. Pad 19 is used to affix the dielectric enclosure 12 to the exterior surface of window 20.

An interior dielectric enclosure 16 has an electrically conductive shield 15 which forms an electrically conductive cavity 22. The shield may be a conductive screen disposed against the interior surface of a dielectric housing or interior enclosure 16. An interior printed circuit board 14 is enclosed within the enclosure 16 and forms a face therewith. The cavity 22 is adjacent the circuit board 14. Shield 15 connects to ground ring 17 of the circuit board 14. A coaxial cable 18 having an inner conductor and outer shield conductor may be connected to a resonant coupling circuit, more fully described below, on circuit board 14. The outer shield conductor of cable 18 may be connected to ground ring 17 and the conductive shield, and the inner conductor may be connected to a resonant coupling circuit 30 illustrated in FIG. 3. Advantageously a ground ring is located on both sides of the circuit board. The other end of the coaxial cable 18 may be connected to a radio transceiver, such as a cellular radio telephone (not illustrated).

A second adhesive dielectric pad 19 may be adhered to the circuit board 14 and the face of enclosure 12. The adhesive dielectric pad 19 may have adhesive on both of its faces and is used to affix the dielectric enclosure 16 to the interior surface of window 20. Exterior enclosure 12 and interior enclosure 16 are positioned in physical alignment. The present invention may be easily installed onto a vehicle window without special tools or knowledge and easily achieve an efficient antenna system with minimum VSWR.

Referring now to FIGS. 3 and 4, the interior antenna printed circuit board 14 is illustrated. Printed circuit board strip line inductor 30 is connected to ground ring 17, forming a DC ground that minimizes electrostatic buildup. The center conductor of coaxial cable 18 connects to the printed circuit board inductor 30 at connection 24. The location of connection point 24 determines the proper impedance match of the antenna system to the 50 ohm characteristic impedance of the coaxial cable 18. The shield conductor of coax 18 connects to connection point 26 which electrically connects the outer shield of coax 18 to ground ring 17. The ground ring 17 is used to make contact with shield 15 when the interior dielectric enclosure is in communication with the printed circuit board 14. Thus, a grounded cavity 22 forms from the connection of shield 15 and ground ring 17. The shield 15, ground ring 17 and printed circuit board inductor 30 form a parallel resonant circuit (i.e., a cavity backed monopole) at the frequency band of interest.

Referring now to FIG. 4, the exterior antenna printed circuit board 13 is illustrated. The printed circuit board 13 has a strip line inductor 32. The inductor 32 is connected to antenna radiating element 10 at connection point 28. Printed circuit board inductor 32 and antenna radiating element 10 form a resonant circuit at the frequency bands of interest. Each inductor 30 and 32 are part of a resonant coupling circuit. When both of these inductors are placed in close proximity of each other, radio frequency energy is electromagnetically transferred by inductive coupling. Inductively coupling resonant circuits results in efficient transfer of radio frequency energy between the interior and exterior parts of the system of the present invention. The circuit board inductors 30 and 32 resonate with the capacitive loading from the shield 15 and structural capacitance of the antenna radiating element 10, respectively.

a further advantage of the present invention is an effective ground counterpoise that results from the tuned resonant structure of the interior enclosure 16 in conjunction with the shield 15 and inductor 30. This tuned ground counterpoise effectively minimizes radio frequency energy from coupling back on the outside of the coaxial cable 18 outer shield conductor. This contributes to the uniformity of the present antenna system radiation pattern and reduces stray radio frequency energy within the vehicle that may interfere with computer control systems and the possibility of affecting humans by being near field radio frequency radiation. An antenna system has been described that is effective over a large bandwidth and having a low VSWR and works well with modern solid state radio frequency mobile transceivers. The present invention has an omnidirectional radiation pattern and may be mounted on a vehicle window so as to take advantage of maximum height and best clearance of the vehicle body. An effective resonant ground counterpoise is utilized to improve the effective radiation pattern and to minimize the dangers of high power radio frequency energy from radiating inside the passenger compartment of a vehicle. In addition, the antenna system of the present invention may be easily installed by unskilled personnel without special knowledge, tools or test equipment by following simple directions for installation in a typical modern day vehicle.

A quality antenna system has been disclosed that may be mass-produced at low costs using efficiencies in manufacture of simple standard components that do not require extensive tooling, assembly or fabrication time. Ease of use and non-critical components add to the long-term reliability of the present antenna system so that minimal degradation of the described antenna system can be expected over the life of the product.

Installation and/or transfer of the antenna system from one vehicle to another is easily accomplished by unskilled labor and only requires the expenditure of installing or replacing the adhesive pads that attach the exterior and interior parts of the antenna system to the vehicle window. Therefore, the present invention has fulfilled a long-felt need in the mobile radio communications industry for an easily installed, reliable, efficient and inexpensive antenna that may be mass produced and utilized by the public without additional expense or special installation techniques, knowledge, tools or test equipment.

The system of the present invention, therefore, is well adapted to carry out the objects and attain the ends and advantages mentioned as well as others inherent therein. While the presently preferred embodiment of the invention has been described, numerous changes in the details of construction and arrangement of parts will readily suggest themselves to those skilled in the art and which are encompassed within the spirit of the invention and the scope of the appended claims.

What is claimed is:

1. A UHF band antenna system for mobile vehicular communications using radio frequency signals, comprising:

an exterior antenna part having a first UHF band resonant coupling circuit;

a locally referenced, isolating interior counterpoise part having a second UHF band resonant coupling circuit, wherein said second UHF band resonant circuit is a cavity backed monopole and wherein both exterior and interior parts are configured to attach to respective exterior and interior surfaces, of a vehicle window such that said first and second resonant coupling circuits electromagnetically communicate ultra high frequency band signals between said exterior and interior parts and wherein said interior and exterior parts are inductively coupled.

2. The antenna system of claim 1, wherein the exterior antenna part comprises:

an antenna element having top and bottom ends;

an angle adjusting mechanism having first and second parts, said first part attached to said antenna element bottom end;

a first enclosure fixedly attached to said angle adjusting mechanism second part;

a first printed circuit board having a first printed circuit inductor, said first printed circuit board enclosed within said first enclosure and forming a face therewith opposite said angle adjusting mechanism; and said first printed circuit inductor connected to said antenna element bottom end forming a resonant circuit therewith, wherein said first printed circuit inductor is part of the first resonant coupling circuit.

3. The antenna system of claim 1, wherein the interior counterpoise part comprises:

an enclosure having an electrically conductive surface, at least partly defining said cavity;

a printed circuit board having a printed circuit board inductor forming a part of said cavity backed monapole, said printed circuit board enclosure within said enclosure and forming a face therewith;

a coaxial cable having an inner conductor and outer shield conductor, said coaxial cable inner and outer conductors connected to said printed circuit board inductor and said enclosure conductive surface, respectively;

said printed circuit board inductor connected to said enclosure conductive surface forming a resonant circuit therewith, wherein said printed circuit board inductor is part of the second resonant coupling circuit.

4. The antenna system of claim 1, wherein the interior counterpoise part is connected to a radio transceiver by coaxial cable.

5. The antenna system of claim 1, further comprising adhesive pads attached to said exterior and interior parts.

6. The antenna system of claim 2, wherein said first printed circuit board further comprises a strip inductor.

7. The antenna system of claim 3, wherein said printed circuit board further comprises a strip inductor.

8. The antenna system of claim 4, wherein the coaxial cable is impedance matched in connecting to said interior part.

9. The antenna system of claim 4, wherein said interior counterpoise is configured to prevent radio frequency energy radiating from the coaxial cable outer shield.

10. The antenna system of claim 1, wherein said first and second resonant coupling circuits are nonadjustable after installation.

11. The antenna system of claim 2, wherein the antenna element is an approximately one half wave vertical element.

12. The antenna system of claim 2, wherein the antenna element is a collinear phased vertical element.

13. The antenna system of claim 3, wherein the electrically conductive surface is conductive copper screen.

14. The antenna system of claim 3, wherein the electrically conductive surface is conductive foil.

15. The antenna system of claim 3, wherein the electrically conductive surface is a conductive coating on the inside of said enclosure.

16. A UHF band antenna system for mobile vehicular communications using radio frequency signals, comprising:

an antenna element having top and bottom ends;

an angle adjusting mechanism having first and second parts, said first part attached to said antenna element bottom end;

a first enclosure fixedly attached to said angle adjusting mechanism second part;

a first printed circuit board having a first printed circuit inductor, wherein said first printed circuit board is received in said first enclosure;

said first printed circuit inductor connected to said antenna element bottom end forming a resonant circuit therewith, wherein said first printed circuit inductor is used in a first resonant coupling circuit;

a second enclosure having an electrically conductive surface;

a second printed circuit board having a second printed circuit inductor received in said second enclosure;

a coaxial cable having an inner conductor and outer shield conductor, said coaxial cable inner and outer conductors connected to said second printed circuit board inductor and said second enclosure conductive surface, respectively;

said second printed circuit board inductor is connected to said electrically conductive surface of said second enclosure forming a resonant circuit therewith and forming a locally referenced, isolating cavity backed monopole, wherein said second printed circuit board inductor is used in a second resonant coupling circuit;

said first enclosure is mounted proximally to said second enclosure such that said first and second resonant coupling circuits electromagnetically communicate ultra high frequency band signals between said antenna element and said coaxial cable.

17. A UHF antenna band system for mobile vehicular communications using radio frequency signals, comprising:

an antenna element having top and bottom ends;

an angle adjusting mechanism having first and second parts, said first part attached to said antenna element bottom end;

a first enclosure fixedly attached to said angle adjusting mechanism second part;

a first printed circuit board having a strip inductor, wherein said first printed circuit board is received in said first enclosure;

said first printed circuit inductor connected to said antenna element bottom end forming a resonant circuit therewith, wherein said first printed circuit inductor is part of a first resonant coupling circuit;

a second enclosure mounted proximally to said first enclosure and having an electrically conductive surface;

a second printed circuit board having a strip inductor received in said second enclosure;

a coaxial cable having an inner conductor and outer shield conductor, said coaxial cable inner and outer conductors connected to said second printed circuit board inductor and said second enclosure conductive surface, respectively;

said second printed circuit board inductor is connected to said electrically conductive surface of said second enclosure forming a resonant circuit therewith and forming a cavity backed monopole, wherein said second printed circuit board inductor is part of a second resonant coupling circuit.

* * * * *